United States Patent [19]

Kuwashima et al.

[11] Patent Number: 5,030,553

[45] Date of Patent: Jul. 9, 1991

[54] DIRECT POSITIVE PHOTOGRAPHIC PHOTOSENSITIVE MATERIALS

[75] Inventors: Shigeru Kuwashima; Shigeo Hirano, both of Kanagawa, Japan

[73] Assignee: Fuji Photo Film Co., Ltd., Kanagawa, Japan

[21] Appl. No.: 472,932

[22] Filed: Jan. 31, 1990

[30] Foreign Application Priority Data

Jan. 31, 1989 [JP] Japan ..... 1-19423

[51] Int. Cl.[5] ..... G03C 1/485

[52] U.S. Cl. ..... 430/598; 430/567; 430/940

[58] Field of Search ..... 430/598, 567, 940

[56] References Cited

U.S. PATENT DOCUMENTS

| | | | |
|---|---|---|---|
| 3,317,322 | 5/1967 | Porter et al. | 430/567 |
| 4,504,570 | 3/1985 | Evans et al. | 430/567 |
| 4,828,973 | 5/1989 | Hirano et al. | 430/598 |
| 4,871,653 | 11/1989 | Inoue et al. | 430/598 |

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

Disclosed are direct positive photographic photosensitive materials which have at least one internal latent image core/shell type silver halide emulsion layer, which has not been pre-fogged, on a support wherein the silver halide molar ratio of the core and shell of the emulsion is not more than 1/5, and wherein at least one type of compound which can be represented by the formula (N-I) indicated below is included in the photosensitive material.

(N-I)

In this formula, Z represents a non-metal atomic group which is required to form a 5- or 6-membered heterocyclic ring, and Z may be substituted with substituents. $R^1$ is an aliphatic group, and $R^2$ is a hydrogen atom, an aliphatic group or an aromatic group. $R^1$ and $R^2$ may be substituted with substituents. Furthermore, $R^2$ may be joined to the heterocyclic ring which is completed by and form a ring. However, at least one of the groups represented by $R^1$, $R^2$ and Z contains an alkynyl group, acyl group, hydrazine group or hydrazone group, or alternatively a 6-membered ring is formed with $R^1$ and $R^2$ and a dihydropyridinium skeleton is formed. Moreover, at least one of the groups represented by $R^1$, $R^2$ and Z may be a group which promotes adsorption on silver halide. Y is a counter ion for balancing the electrical charge, and n is 0 or 1.

16 Claims, No Drawings

DIRECT POSITIVE PHOTOGRAPHIC PHOTOSENSITIVE MATERIALS

FIELD OF THE INVENTION

This invention concerns direct positive silver halide photographic photosensitive materials, and in particular it concerns direct positive photographic photosensitive materials which contain internal latent image core/shell type silver halide emulsions which have not been pre-fogged, so as to provide a low minimum image density.

BACKGROUND OF THE INVENTION

The photographic method of obtaining direct positive images without the need for a reversal process or negative films is well known.

The practical methods which can be used to form positive images with conventional direct positive silver halide photographic photosensitive materials can be divided into two main types, excluding special cases.

The methods of the first type involve the use of pre-fogged silver halide emulsions. The direct positive image is obtained after development by breaking down the fogging nuclei (latent image) in the exposed parts using, for example, solarization or the Herschel effect.

The methods of the second type involve the use of internal latent image type silver halide emulsions which have not been pre-fogged. The direct positive image is obtained by means of a surface development after performing a post-imagewise exposure fogging treatment or while performing such a fogging treatment.

The internal latent image type silver halide photographic emulsions referred to above are emulsions of a type in which the photosensitive nuclei are present, in the main, within the silver halide grains and with which the latent image formed by exposure to light is formed mainly within the grains.

Silver halide emulsion grains which have a core/shell structure comprising at least two layers are known as internal latent image type silver halide photographic emulsions of the latter type. They are called core/shell type silver halide emulsions.

Of the two types of method mentioned above, those of the latter type generally provide a higher photographic speed than those of the former type and they are suitable for use in applications when high photographic speeds are required. The present invention is concerned with methods of this latter type.

Various techniques are known in this field of technology. For example, the principal techniques have been disclosed in the specifications of U.S. Pat. Nos. 2,592,250, 2,466,957, 2,497,875, 2,588,982, 3,317,322, 3,761,266, 3,761,276 and 3,796,577, and British Patents 1,151,363, 1,150,553 and 1.011,062.

It has been possible to make comparatively high speed photographic photosensitive materials of the direct positive type using these known methods.

Furthermore, details of the mechanism by which direct positive images are formed have been disclosed, for example, in *The Theory of the Photographic Process*, by T. H. James, fourth edition, chapter 7, pages 182–193, and in U.S. Pat. No. 3,761,276.

Thus, it is thought that a photographic image (i.e., direct positive image) is formed in the unexposed parts by forming fog nuclei selectively only on the surfaces of the silver halide grains in the unexposed parts on the basis of the surface desensitizing action originating from the so-called internal latent image. This image is produced within the silver halide by means of an initial imagewise exposure and then subjecting the material to an ordinary so-called surface development process.

Methods in which the whole surface of the photosensitive layer is given a second exposure, known generally as "light fogging methods" (for example, British Patent 1,151,363) and methods in which nucleating agents are used, known as "chemical fogging methods", are known as means of producing fog nuclei selectively in the way described above. The latter method has been described, for example, in *Research Disclosure*, volume 151, No. 15162, pages 76–78 (published November 1976).

The internal latent image type silver halide photosensitive material is subjected to a surface color development treatment after a fogging treatment has been performed or while a fogging treatment is being performed. The material is then bleached and fixed (or bleach-fixed) to provide a direct positive color image. The material is normally subjected to a water washing process and/or a stabilization process after the bleaching and fixing processes.

However, when direct positive images are formed using the chemical fogging method, the rate of development is slower than that in the case of an ordinary negative type material and the processing time is prolonged. Consequently, in the past the pH and/or the temperature of the development bath has been raised to shorten the processing time. However, there is a problem in that the minimum image density of the direct positive image obtained generally increases as the pH is raised.

On the other hand, there are various technical problems with the light fogging method since it is used for various purposes in the field of photography. That is to say, with the light fogging method the appropriate exposure brightness and the level of exposure differ according to the type and characteristics of the silver halide which is used since this method is based upon the formation of fog nuclei by the photodegradation of silver halide. Consequently, it is difficult to obtain a constant level of performance and, moreover, there is a further disadvantage in that the development apparatus is complicated and expensive. Furthermore, the development rate is still unsatisfactory.

Furthermore, a surface chemical sensitization process can be carried out with the internal latent image type silver halide emulsions, and especially with the core/shell type silver halide emulsions, in order to increase the maximum density of the direct positive image which is obtained. However, chemical sensitization to increase the maximum image density often results in an increase in the minimum image density as well. Consequently, surface chemical sensitization usually has to be stopped at an appropriate level. In that case the chemically sensitized nuclei formed on the surface are weaker than those obtained with a normal negative type material. There is the further disadvantage that the ageing stability is adversely affected to a considerable degree and so this technique is of limited value. Hence, there has been a need to reduce the fog level of core/shell type silver halide emulsions.

A pronounced increase in minimum density resulting from slight changes in conditions (especially changes in the state of agitation of the system) as mentioned above is a particular problem with core/shell type silver halide emulsions. This causes major problems when scaling up for production and with repeat reproducibility because of the increase in minimum image density. Furthermore, the increase in minimum image density is sometimes such that the minimum image density increases further after long term ageing, and performance as a photosensitive material is adversely affected to a considerable degree.

The addition of stabilizers such as 4-hydroxy-6-methyl-1,3,3a,7-tetra-azaindene and 1-phenyl-5-mercaptotetrazole for example, compounds well known in the past for improving material with respect to the problems of increasing minimum image densities and variation in performance due to ageing, has been investigated. But large amounts of these compounds must be added in order to prevent any change in performance due to ageing, and it is therefore impossible to avoid having some adverse effect on the photographic performance obtained. In practical terms, these adverse effects include a lowering of the maximum density of the positive image due to a development inhibiting action and an increase in re-reversal image speed. Moreover, when spectral sensitization is carried out in the usual way with the silver halide emulsions, these compounds inhibit the adsorption of the sensitizing dyes and have an adverse effect on the increase in speed due to spectral sensitization. Therefore, discovery of technique for improving ageing stability while avoiding these adverse effects is clearly desirable.

Moreover, pressure is sometimes applied to the emulsions of photographic photosensitive materials by contact with the machine during the various processes from exposure through development processing. This pressure can result in a change in performance after processing due to pressure sensitization and desensitization. Improvement in resistance to such pressure is also desirable for core/shell internal latent image type silver halide emulsions.

SUMMARY OF THE INVENTION

Hence, the aims of the present invention are as follows:

(1) To provide core/shell internal latent image type direct positive silver halide photographic materials which have a low minimum image density.

(2) To provide core/shell internal latent image type direct positive photographic materials which have a low minimum image density irrespective of the conditions at the time of the formation of the grains of the internal latent image type silver halide emulsion.

(3) To provide core/shell internal latent image type direct positive photographic materials with which the minimum image density remains unchanged at a low level even after ageing.

(4) To provide core/shell internal latent image type direct positive photographic materials which are resistant to pressure sensitization or pressure desensitization.

The above aims of the present invention have been realized by means of direct positive photographic photosensitive materials which have at least one internal latent image core/shell type silver halide emulsion layer which has not been pre-fogged on a support. The silver halide molar ratio of the core and shell of the emulsion is not more than 1/5, and at least one type of compound represented by the formula (N-I) indicated below is included in the aforementioned photosensitive material.

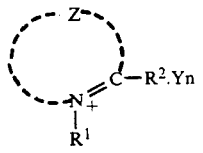

(N-I)

wherein Z represents a non-metal atomic group which is required to form a 5- or 6-membered heterocyclic ring, and Z may be substituted with substituents. $R^1$ is an aliphatic group, and $R^2$ is a hydrogen atom, an aliphatic group or an aromatic group. $R^1$ and $R^2$ may be substituted with substituents. Furthermore, $R^2$ may be joined to the heterocyclic ring which is completed by Z and form another ring. However, at least one of the groups represented by $R^1$, $R^2$ and Z contains an alkynyl group, an acyl group, a hydrazine group or a hydrazone group as a substituent, or alternatively a 6-membered ring is formed with $R^1$ and $R^2$ and a dihydropyridinium skeleton is formed. Moreover, at least one of the groups represented by $R^1$, $R^2$ and Z may be a group which promotes adsorption on silver halide. Y is a counter ion for balancing the electrical charge, and n is 0 or 1.

DETAILED DESCRIPTION OF THE INVENTION

The silver halide molar ratio of the core and shell of the above mentioned internal latent image type core/shell emulsions which are used in the present invention is not more than 1/5, and preferably not more than 1/6, but not less than 1/100.

The above mentioned emulsions are used in at least one emulsion layer in a direct positive photographic photosensitive material of this present invention, but they are preferably used in all emulsion layers. Furthermore, the above mentioned emulsions and the aforementioned compounds represented by the formula (N-I) are preferably used in the same layer, but a certain effect is obtained in those cases where they are used in different layers. The aforementioned compounds represented by the formula (N-I) function as nucleating agents, as disclosed in, for example, JP-A-63-301942 (corresponding to U.S. Pat. No. 4,859,579) and JP-A-01-145646. (The term "JP-A" as used herein means an "unexamined published Japanese patent application".).

When the aforementioned silver halide emulsions have a core and shell silver halide molar ratio greater than 1/5, there tends to be a pronounced variation in photographic performance due to the rate of agitation during preparation. In this invention it has been discovered as a result of the research mentioned above that excellent photographic performance can be realized by the conjoint use of a core and shell silver halide molar ratio of not more than 1/5 and the aforementioned nucleating agents which are represented by the formula (N-I).

The internal latent image type silver halide emulsions which have not been pre-fogged of the invention are emulsions containing silver halides in which the surface of the grains has not been pre-fogged and in which the latent image is formed principally within the grains. They are silver halide emulsions which, when coated at a fixed rate (0.5 -3 g/m$^2$) on a transparent support, the maximum density measured using the normal method for measuring photographic density after exposure for a fixed time of from 0.01 to 10 seconds and developing for 5 minutes at 18° C. in the developer A (an internal type developer having the composition indicated below), is at least five times, and more desirably at least ten times, the maximum density obtained on coating and exposing the emulsion in the same way as before and developing the silver halide emulsion for 6 minutes at 20° C. in developer B (a surface type developer having the composition indicated below).

| | |
|---|---|
| Internal Developer A | |
| Metol | 2 grams |
| Sodium sulfite (anhydrous) | 90 grams |
| Hydroquinone | 8 grams |
| Sodium carbonate (mono-hydrate) | 52.5 grams |
| KBr | 5 grams |
| KI | 0.5 gram |
| Water to make up to | 1 liter |
| Surface Developer B | |
| Metol | 2.5 grams |
| L-Ascorbic acid | 10 grams |
| $NaBO_2.4H_2O$ | 35 grams |
| KBr | 1 gram |
| Water to make up to | 1 liter |

Actual examples of internal latent image type emulsions include the core/shell type silver halides disclosed in U.S. Pat. Nos. 3,761,276, 3,850,637, 3,923,513, 4,035,185, 4,395,478 and 4,504,570, JP-A-52-156614, JP-A-55-127549, JP-A-53-60222, JP-A-56-22681, JP-A-59-208540, JP-A-60-107641, JP-A-61-3137, and in the patents disclosed on page 236 of *Research Disclosure* No. 23510 (published November 1983). As mentioned earlier, the core to shell silver halide molar ratio is not more than 1/5, and preferably not less than 1/100.

The core/shell type silver halide grains having a core/shell silver halide molar ratio of not more than 1/5 used in the present invention can be prepared by the method as described in, for example, U.S. Pat. Nos. 3,317,322, 3,761,276, 4,504,570, etc. However, since the silver halide molar ratio of core to shell is very low, careful attention would be required for controlling variation of the silver halide grains during the ripening of the core grains. Such techniques which are useful for stabilizing the core grains are also disclosed in JP-A-01-197742.

The silver halide grains used in the present invention may have a regular crystalline form such as a cubic, octahedral, dodecahedral or tetradecahedral form, an irregular crystalline form such as a spherical form, or they may be grains which have a tabular form having a length/thickness ratio of at least 5. Furthermore, the grains may have a composite form consisting of various crystalline forms, and the emulsion may comprise mixtures of these forms.

The silver halide composition can be silver chloride, silver bromide or a mixed silver halide, and preferred silver halides for use in the present invention include silver chloro(iodo)bromide, silver (iodo)chloride or silver (iodo)bromide which are silver iodide free or contain not more than 3 mol % silver iodide based on the silver halide content in each of the silver halide emulsion layers.

The average grain size of the silver halide is preferably not more than 2 μm but at least 0.1 μm, and most desirably not more than 1 μm but at least 0.15 μm. The grain size distribution may be narrow or wide. However, the use of so-called "mono-disperse" silver halide emulsions in which at least 90% of all the grains in terms of the number of grains or weight are of a size within ±40%, and preferably within ±20%, of the average grain size is preferred for improving graininess and sharpness for example. Furthermore, two or more mono-disperse silver halide emulsions which have a different grain size or a plurality of grains which have different speeds with the same grain size can be mixed in the same layer or lamination coated on separate layers in an emulsion layer which has essentially the same color sensitivity in order to satisfy the gradation requirements of the photosensitive material. Moreover, mixed or laminated combinations of two or more types of poly-disperse silver halide emulsion or combinations of mono-disperse emulsions and poly-disperse emulsions can be used.

The silver halide emulsions used in the present invention can be chemically sensitized internally or at the surface using sulfur or selenium sensitization, reduction sensitization or precious metal sensitization either independently or conjointly. Practical details have been given, for example, in the patents disclosed in *Research Disclosure* No. 17643-III, page 23 (published December 1978).

The photographic emulsions used in the present invention are spectrally sensitized in the usual way using photographically useful sensitizing dyes. Cyanine dyes, merocyanine dyes and complex merocyanine dyes are especially useful, and these dyes can be used individually or in combinations. Super-sensitizing agents can be used conjointly with the above mentioned dyes. Details have been given, for example, in the patents disclosed in *Research Disclosure* No. 17643-IV, pages 23–24 (published December 1978).

Anti-foggants or stabilizers can be included in the photographic emulsions used in the present invention to prevent the occurrence of fogging during the manufacture, storage or photographic processing of the photosensitive material or to stabilize photographic performance.

The compounds which can be represented by the formula (N-I) indicated below of present invention are described below.

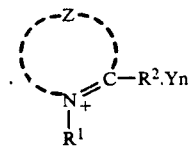

(N-I)

In this formula, Z represents a non-metal atomic group which is required to form a 5- or 6-membered heterocyclic ring, and Z may be substituted with substituents. $R^1$ is an aliphatic group, and $R^2$ is a hydrogen atom, an aliphatic group or an aromatic group. $R^1$ and $R^2$ may be substituted with substituents. Furthermore, $R^2$ may be joined to the heterocyclic ring which is completed by Z and form a ring. However, at least one of the groups represented by $R^1$, $R^2$ and Z contains an alkynyl group, an acyl group, a hydrazine group or a hydrazone group as a substituent. Or a 6-membered ring is formed with $R^1$ and $R^2$ and a dihydropyridinium skeleton is formed. Moreover, at least one of the groups represented by $R^1$, $R^2$ and Z may be a group which promotes adsorption on silver halide. Y is a counter ion for balancing the electrical charge, and n is 0 or 1.

In more detail, the heterocyclic ring completed by Z may be, for example, a quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolinium, naphthoxazolium or benzoxazolium nucleus. Examples of substituents for Z include alkyl, alkenyl, aralkyl, aryl, alkynyl, hydroxyl, alkoxy and aryloxy groups, halogen atoms, amino, alkylthio, arylthio, acyloxy, acylamino, sulfonyl, sulfonyloxy, sulfonylamino, carboxyl, acyl, carbamoyl, sulfamoyl, sulfo, cyano, ureido, urethane, carboxylic acid ester, hydrazine, hydrazone and imino groups. At least one of the above mentioned groups or atoms can be selected, for example, as a substituent for Z. In those cases where there are two or more substituents, these groups may be the same or different. Furthermore, the above mentioned substituents may be further substituted with these substituents.

Moreover, the substituent for Z may be a heterocyclic quaternary ammonium group which is completed by Z and which is connected via an appropriate divalent linking group L. In this case, the compound of the formula (N-1) has a so-called dimer structure. Examples of the linking group L are the same as those described for $L^1$ below.

The preferred heterocyclic rings completed by Z are quinolinium, benzothiazolium, benzimidazolium, pyridinium, acridinium, phenanthridinium and isoquinolinium nuclei. Of these, the quinolinium and benzothiazolium nuclei are preferred, and the quinolinium nucleus is the most desirable.

The aliphatic groups represented by $R^1$ and $R^2$ are unsubstituted alkyl groups which have from 1 to 18 carbon atoms, or substituted alkyl groups of which the alkyl part has from 1 to 18 carbon atoms. These groups may be substituted with the same substituents as Z.

The aromatic groups represented by $R^2$ have from 6 to 20 carbon atoms, and examples include the phenyl and naphthyl groups. These groups may be substituted with the same substituent groups as Z. Aliphatic groups are preferred for $R^2$, and the methyl group and substituted methyl groups are the most desirable, and there are cases in which these groups are joined to the heterocyclic ring completed by Z and form a ring.

At least one of the groups represented by $R^1$, $R^2$ and Z has an alkynyl group, an acyl group, a hydrazine group or a hydrazone group as a substituent, or alternatively a 6-membered ring is formed by $R^1$ and $R^2$ and a dihydropyridinium skeleton is formed, and these may be substituted with the groups described earlier as substituents for the group represented by Z.

Those compounds in which at least one of the substituents of $R^1$ and $R^2$ and the ring represented by Z is an alkynyl group or an acyl group, and those compounds in which $R^1$ and $R^2$ are joined together and a dihydropyridinium skeleton is formed are preferred. Those compounds in which there is at least one alkynyl group are most desirable, and the propargyl group is especially desirable.

The substituents of $R^1$, $R^2$ and Z which promote adsorption on silver halide are represented by $X^1$-$(L^1)_m$-. Here, $X^1$ is a group which promotes adsorption on silver halide, $L^1$ is a divalent linking group, and m is 0 or 1.

The group represented by $X^1$ which promotes adhesion on silver halide is preferably a thioamido group, a mercapto group or a 5- or 6-membered nitrogen-containing heterocyclic group.

These groups may be substituted with the substituent groups described as substituents for Z. Non-cyclic thioamido groups (for example, thiourethane group, thioureido group) are preferred for the thioamido group.

The mercapto groups of $X^1$ are preferably heterocyclic mercapto groups (for example, 5-mercaptotetrazole, 3-mercapto-1,2,4-triazole, 2-mercapto-1,3,4-thiadiazole or 2-mercapto-1,3,4-oxadiazole groups).

The 5- or 6-membered nitrogen-containing heterocyclic rings represented by $X^1$ contain combinations of nitrogen, oxygen, sulfur and carbon atoms. Those which form iminosilver, for example benzotriazole and aminothiatriazole, are preferred.

The divalent linking group represented by $L^1$ is an atom or an atomic group containing at least one atom selected from among C, N, S and O atoms. In practice, this may be, for example, an alkylene group, an alkenylene group, an alkynylene group, an arylene group, —O—, —S—, —NH—, —N=, —CO—, —$SO_2$— (these may be substituted with substituents) either alone or combination. Examples of preferred combinations include $$-\overset{O}{\overset{\|}{C}}O-,\ -\overset{O}{\overset{\|}{C}}NH-,\ -NHSO_2NH-,\ -O\overset{O}{\overset{\|}{C}}NH-,$$

$$-NH\overset{O}{\overset{\|}{C}}NH-,\ -NHSO_2NH,\ \text{-(alkylene)-}\overset{O}{\overset{\|}{C}}NH-,$$

$$\text{-(arylene)-}SO_2NH-,\ \text{-(arylene)-}NH\overset{O}{\overset{\|}{C}}NH-\ \text{and}$$

$$\text{-(arylene)-}\overset{O}{\overset{\|}{C}}NH-.$$

The counter ion Y for balancing the electrical charge may be, for example, a bromide ion, chloride ion, iodide ion, p-toluenesulfonate ion, ethylsulfonate ion, perchlorate ion, trifluoromethanesulfonyl ion, thiocyanate ion, tetrafluoroborate ion or hexafluorophosphate ion.

These compounds and methods for their synthesis have been disclosed, for example, in the patents disclosed in *Research Disclosure* No. 22534 (January 1983, pages 50–54) and ibid, No. 23213 (August 1983, pages 267–270), and in JP-B-49-38164, JP-B-52-19452, JP-B-52-47326, JP-A-52-69613, JP-A-52-3426, JP-A-55-138742, JP-A-60-11837, and U.S. Pat. Nos. 4,306,016 and 4,471,044. (The term "JP-B" as used herein means an "examined Japanese patent publication".)

Examples of compounds which can be represented by the formula (N-I) are indicated below, but the invention is not limited by these examples.

(N-I-1)

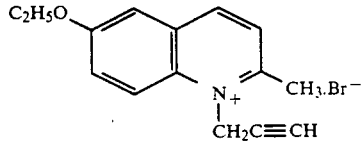

-continued
(N-I-2)
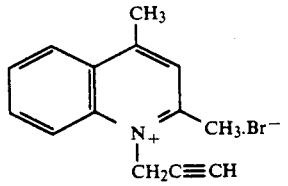
(N-I-3)
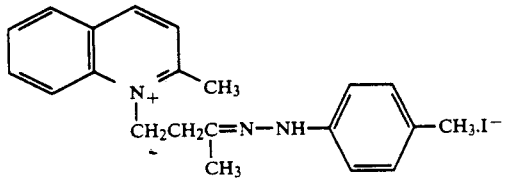
(N-I-4)
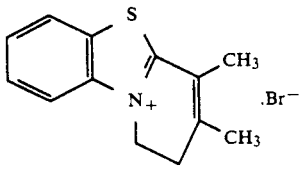
(N-I-5)
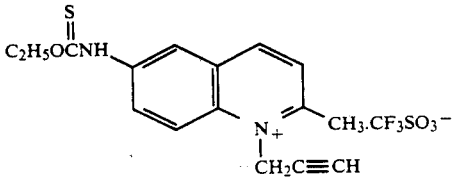
(N-I-6)
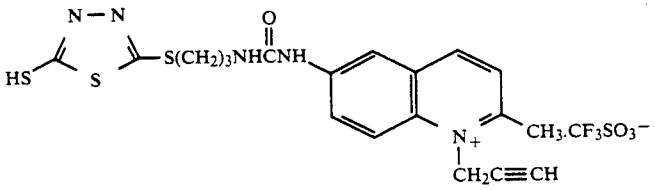
(N-I-7)
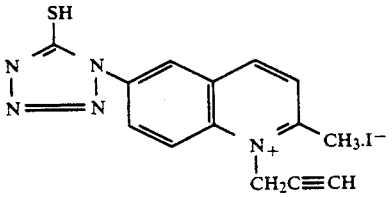
(N-I-8)
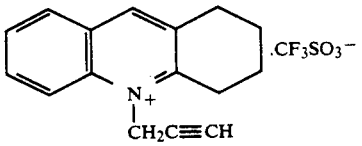
(N-I-9)
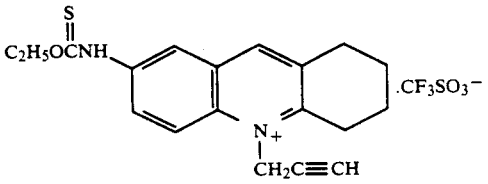

-continued
(N-I-10)
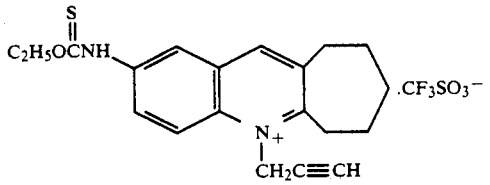
(N-I-11)
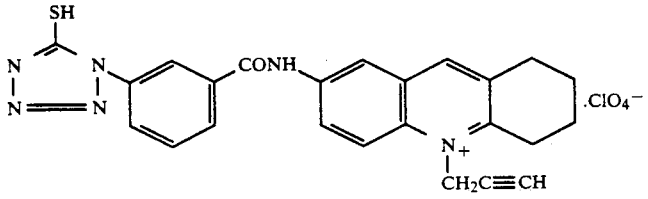
(N-I-12)
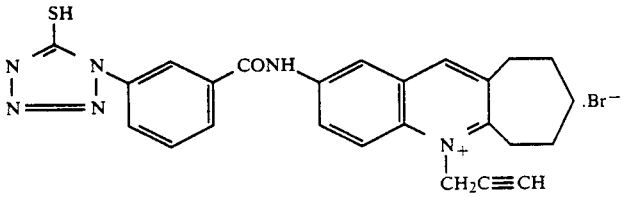
(N-I-13)
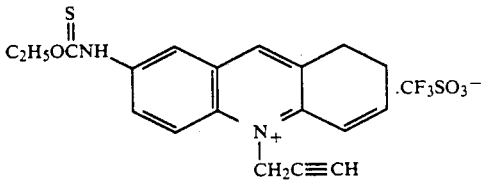
(N-I-14)
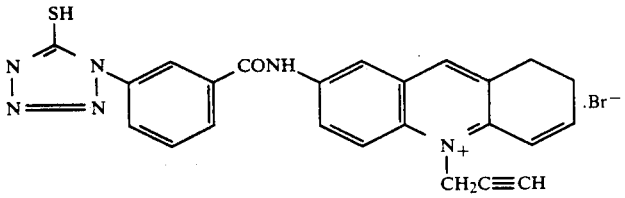
(N-I-15)
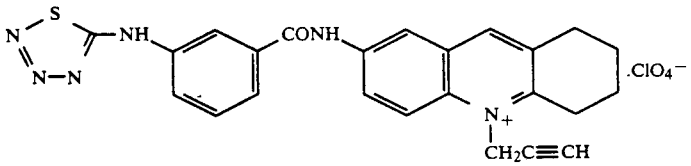
(N-I-16)
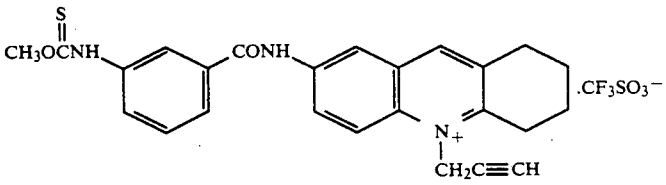
(N-I-17)
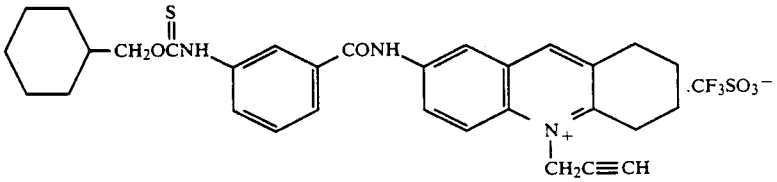

-continued (N-I-18)

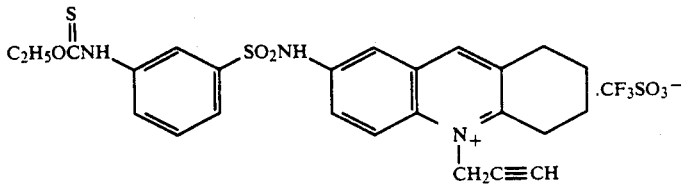

(N-I-19)

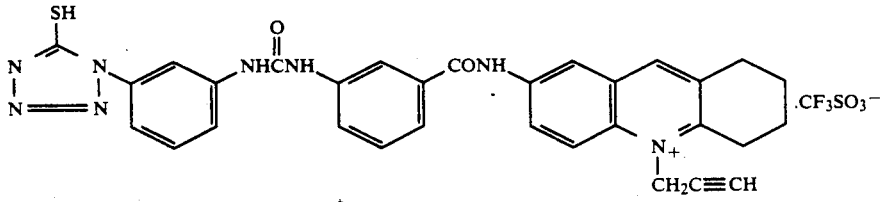

(N-I-20)

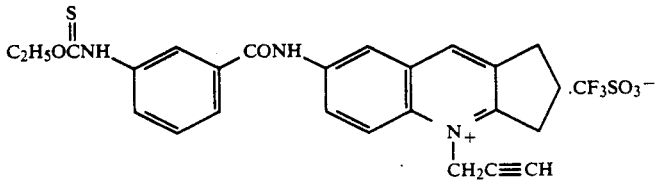

Other nucleating agents can be used conjointly with the above mentioned nucleating agents represented by formula (N-I) in the present invention. In particular, compounds represented by the formula (N-II) indicated below can be used conjointly. The amount of the compound represented by the formula (N-II) used is preferably less than 50%, and most desirably less than 30, of the total amount of nucleating agent used.

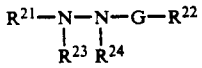

[N-II]

In this formula, $R^{21}$ represents an aliphatic group, an aromatic group or a heterocyclic group, $R^{22}$ represents a hydrogen atom, or an alkyl, aralkyl, aryl, alkoxy, arylthio or amino group, G represents a carbonyl, sulfonyl, sulfoxy, phosphoryl or imino (HN=C<) group, and $R^{23}$ and $R^{24}$ each represents a hydrogen atom, or one represents a hydrogen atom and the other represents an alkylsulfonyl group, an arylsulfonyl group or an acyl group. However, a hydrazone structure (>N—N=C<) which includes G, $R^{22}$, $R^{24}$ and the hydrazine nitrogen may be formed. Furthermore, where possible, the groups mentioned above may be substituted with substituents.

In more detail, $R^{21}$ may be substituted with substituents, and examples of such substituents include alkyl, aralkyl, alkoxy, alkyl or aryl substituted amino, acylamino, sulfonylamino, ureido, urethane, aryloxy, sulfamoyl, carbamoyl, aryl, alkylthio, arylthio, sulfonyl, sulfinyl and hydroxyl groups, halogen atoms, and cyano, sulfo, carboxyl and phosphatoamido groups.

Of these groups, the ureido group and the sulfonylamino group are preferred.

Where possible, these groups may be joined together and form rings.

$R^{21}$ is preferably an aromatic group, an aromatic heterocyclic group or an aryl substituted methyl group, and most desirably is an aryl group (for example, phenyl, naphthyl).

The preferred groups represented by $R^{22}$ are a hydrogen atom, alkyl groups (for example, methyl), aralkyl groups (for example, o-hydroxybenzyl) and aryl (for example, 2-hydroxymethylphenyl) groups, and $R^{22}$ most desirably represents a hydrogen atom.

Further, the substituents indicated in connection with $R^{21}$, $R^{22}$ can also be substituted with acyl, acyloxy, alkyl or aryl oxycarbonyl, alkenyl, alkynyl and nitro groups, for example.

These substituents may be further substituted with these substituents. In those cases where it is possible, these groups may be joined together and form a ring.

Among $R^{21}$ and $R^{22}$, $R^{21}$ may contain a so-called ballast group, such as a group which renders a coupler, for example, fast to diffusion. In particular, $R^{21}$ is preferably linked with a ureido or sulfonylamino group.

There may also be a group $X^2$-$(L^2)_{m2}$ which promotes adsorption on the surface of silver halide grains. Here, $X^2$ is a group which promotes adsorption on silver halide, and it is preferably a thioamido group (with the exception of the thiosemicarbazido group and substituted derivatives thereof), a mercapto group or a 5- or 6-membered nitrogen-containing heterocyclic group. $L^2$ represents a divalent linking group which an atom or an atomic group containing at least one atom selected from among C, N, S and 0 atoms. In practice, this may be, for example, an alkylene group, an alkenylene group, an alkynylene group, an arylene group, —O—, —S—, —NH—, —N=, —CO—, —$SO_2$— (these may be substituted with substituents) either alone or combination. Examples of preferred combinations include those described above for $L^1$. $m^2$ represents a value of 0 or 1.

Moreover, those cases in which $X^2$ is a non-cyclic thioamido group (for example thioureido, thiourethane), a cyclic thioamido group (for example, a mercapto substituted nitrogen containing heterocyclic group, for example 2-mercaptothiadiazole, 3-mercapto-1,2,4-triazole, 5-mercaptotetrazole, 2-mercapto-1,3,4-oxadiazole, 2-mercaptobenzoxazole), or a nitrogen containing heterocyclic group (for example, benzotriazole, benzimidazole, indazole) are preferred.

The most desirable $X^2$ group differs according to the sensitive material in which the compounds are being used. For example, in a color sensitive material where color materials which form dyes on reacting with the oxidized form of a p-phenylenediamine based developing agent (so-called couplers) are being used, mercapto substituted nitrogen containing heterocyclic rings or nitrogen containing heterocyclic rings which form iminosilver are preferred as $X^2$. Furthermore, in color sensitive materials in which color materials which produce diffusible dyes on cross oxidation with the oxidized form of a developing agent (so-called DRR couplers) are used, non-cyclic thioamido groups or mercapto substituted nitrogen containing heterocyclic rings are preferred as $X^2$. Moreover, in black and white sensitive materials mercapto substituted nitrogen containing heterocyclic rings or nitrogen containing heterocyclic rings which form iminosilver are preferred as $X^2$.

$R^{23}$ and $R^{24}$ are preferably hydrogen atoms.

A carbonyl group is preferred for G in formula (N-II)

Furthermore, compounds which have a group which is adsorbed on silver halide, or compounds which have ureido groups, sulfonyl groups or amino groups, are preferred as compounds which can be represented by the formula [N-II].

Examples of these compounds and methods for their preparation, starting with hydrazine based nucleating agents which have groups which can be adsorbed on silver halides, have been disclosed, for example, in U.S. Pat. Nos. 4,030,925, 4,080,207, 4,031,127, 3,718,470, 4,269,929, 4,276,364, 4,278,748, 4,385,108, 4,459,347, 4,478,922 and 4,560,632,British Patent 2,011,391B, JP-A-54-74729, JP-A-55-163533, JP-A-55-74536 and JP-A-60-179734.

Other hydrazine based nucleating agents have been disclosed, for example, in JP-A-57-86829, U.S. Pat. Nos. 4,560,638, 4,478,928, 2,563,785 and 2,588,982.

Examples of compounds which can be represented by the formula (N-II) are indicated below. However, the present invention is not limited to the compounds shown below.

(N-II-1)

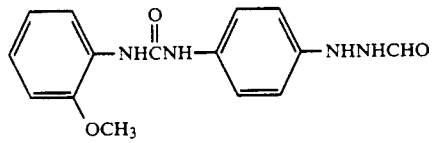

(N-II-2)

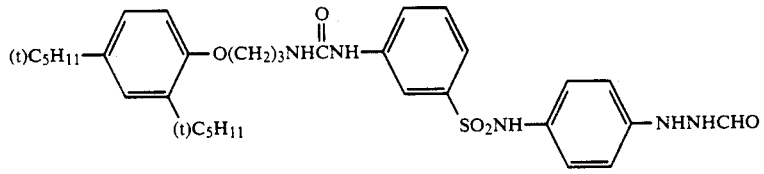

(N-II-3)

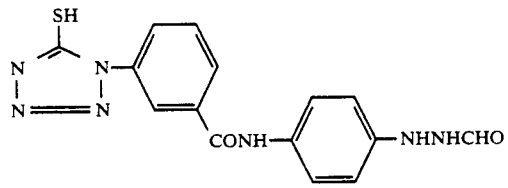

(N-II-4)

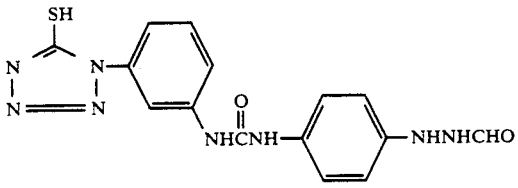

(N-II-5)

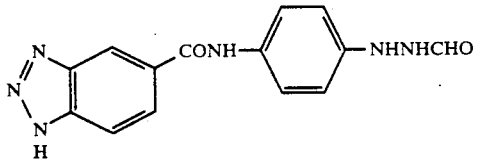

(N-II-6)

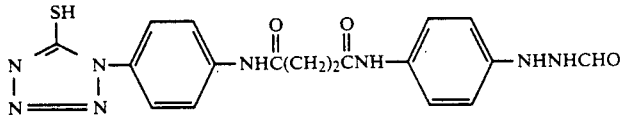

-continued
(N-II-7)
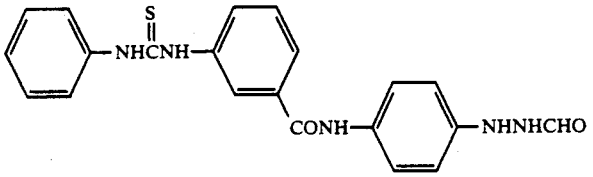
(N-II-8)
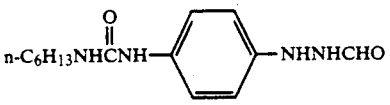
(N-II-9)
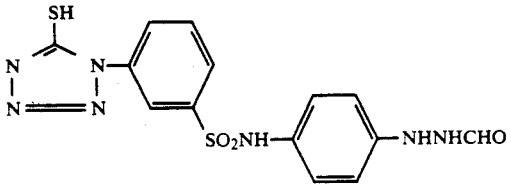
(N-II-10)
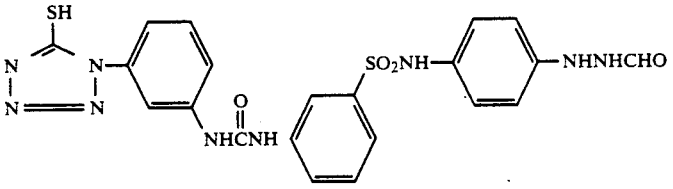
(N-II-11)
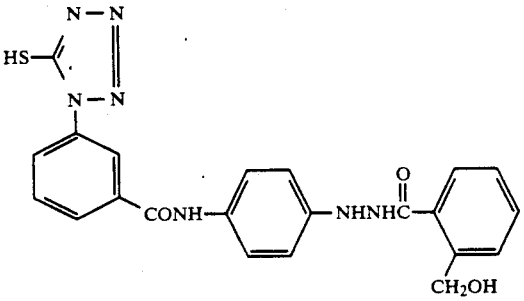
(N-II-12)
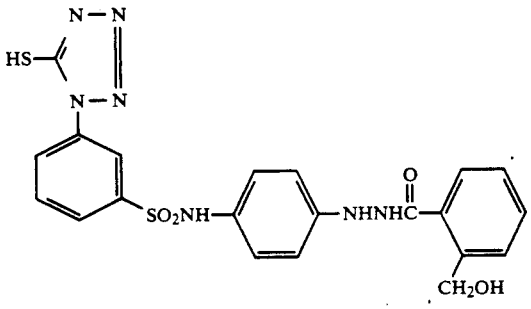
(N-II-13)
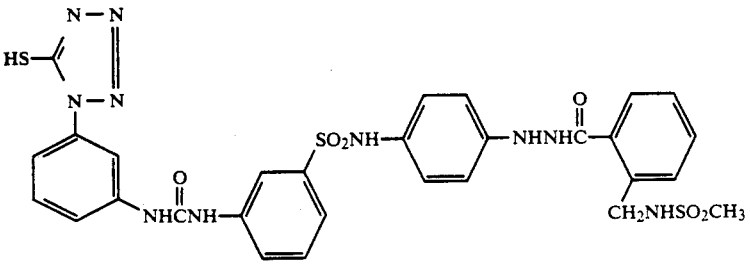

-continued (N-II-14)

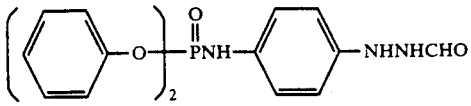

The amount of nucleating agent used in a sensitive material is preferably from $10^{-8}$ to $10^{-2}$ mol, and most desirably from $10^{-7}$ to $10^{-2}$ mol, per mol of silver halide.

The nucleation accelerators indicated below can be used in the present invention to accelerate further the action of the above mentioned nucleating agents.

The compounds disclosed in JP-A-63-106656 (pages 6–16) and tetra-azaindenes, triazaindenes and penta-azaindenes which have at least one mercapto group which may be substituted optionally with an alkali metal atom or an ammonium group can be used as nucleation accelerators.

Examples of nucleation accelerators are indicated below, but the nucleation accelerators are not limited to these examples.

(A-1) 3-Mercapto-1,2,4-triazolo[4,5-a]pyridine
(A-2) 3-Mercapto-1,2,4-triazolo[4,5-a]pyrimidine
(A-3) 5-Mercapto-1,2,4-triazolo[1,5-a]pyrimidine
(A-4) 7-(2-Dimethylaminoethyl)-5-mercapto-1,2,4-triazolo[1,5-a]pyrimidine
(A-5) 3-Mercapto-7-methyl-1,2,4-triazolo[4,5-a]pyrimidine
(A-6) 3,6-Dimercapto-1,2,4-triazolo[4,5-b]pyridazine
(A-7) 2-Mercapto-5-methylthio-1.3,4-thiadiazole
(A-8) 3-Mercapto-4-methyl-1,2,4-triazole
(A-9) 2-(3-Dimethylaminopropylthio)-5-mercapto-1,3,4-thiadiazole hydrochloride
(A-10) 2-(2-Morpholinoethylthio)-5-mercapto-1,3,4-thiadiazole hydrochloride The nucleation accelerator can be included in the photosensitive material or in the processing bath, but its inclusion in an internal latent image type silver halide layer or in some other hydrophilic colloid layer (intermediate layer or protective layer for example) in the photosensitive material is preferred. Most desirably, the nucleation accelerator is included in a silver halide emulsion layer or in a layer adjacent thereto.

Various color couplers can be used to form direct positive color images in the present invention. Color couplers are compounds which undergo a coupling reaction with the oxidized form of a primary aromatic amine based color developing agent and form or release a dye which is essentially fast to diffusion. They are preferably essentially fast to diffusion. Typical examples of useful color couplers include naphthol and phenol based compounds, pyrazolone and pyrazoloazole based compounds, and open chain or heterocyclic ketomethylene compounds. Examples of these cyan, magenta and yellow couplers which can be used in the present invention include the compounds disclosed in *Research Disclosure*, No. 17643 (published December 1978), page 25, section VII-D, and ibid, No. 18717 (published November 1979) and the compounds disclosed in JP-A-62-215272 and in the patents cited therein.

Colored couplers for correcting the unwanted absorbance on the short wavelength side of the dyes which are formed, couplers for which the colored dyes have a suitable degree of diffusibility, non-color forming couplers, DIR couplers which release development inhibitors in accordance with the coupling reaction, and polymerized couplers can also be used in the invention.

Gelatin is useful as a binder or protective colloid which can be used in the emulsion layers and intermediate layers of photosensitive materials of the present invention, but other hydrophilic colloids can be used for this purpose.

Anti-color fogging agents and anti-color mixing agents can be used in photosensitive materials of the present invention.

Typical examples of such compounds have been disclosed on pages 185–193 of JP-A-215272.

Various color intensifiers can be used to increase the color forming properties of the couplers in the present invention. Typical compounds have been disclosed on pages 121–125 of JP-A-62-215272.

Dyes for the prevention of irradiation and halation, ultraviolet absorbers, plasticizers, fluorescent whiteners, matting agents, agents for the prevention of aerial fogging, coating promoters, film hardening agents, antistatic agents and slip improving agents, for example, can be added to photosensitive materials of the present invention. Typical examples of these additives are disclosed in *Research Disclosure*, No. 17643, sections VIII–XIII (published December 1978), pages 25–27, and ibid, No. 18716 (published November 1979), pages 647–651.

The present invention can also be used with multilayer multi-color photographic materials which have at least two different spectral sensitivities on a support. Multi-layer natural color photographic materials usually have at least one red sensitive emulsion layer, at least one green sensitive emulsion layer and at least one blue sensitive emulsion layer on a support. The order of these layers can be changed optionally as required. The preferred order of the layer arrangement is, from the support side, a red sensitive layer, a green sensitive layer, and a blue sensitive layer or, from the support side, a green sensitive layer, a red sensitive layer, and a blue sensitive layer. Furthermore, each of the aforementioned emulsion layers may consist of two or more emulsion layers which have different photographic speeds, and non-photosensitive layers may be present between two or more emulsion layers which have the same color sensitivity. A cyan forming coupler is usually included in the red sensitive layer, a magenta forming coupler is usually included in the green sensitive layer, and a yellow forming coupler is usually included in the blue sensitive layer, but other combinations can be used depending on the particular case.

The inclusion of suitable auxiliary layers, such as protective layers, intermediate layers, filter layers, antihalation layers, backing layers and white reflecting layers for example, in addition to the silver halide emulsion layers, is preferred in photosensitive materials of the present invention.

The photographic emulsion layers and other layers in photographic photosensitive materials of the present invention are coated onto a support as disclosed in *Research Disclosure*, No. 17643, section XVII (published December 1978), page 28, or on a support disclosed in European Patent 0,102,253 or in JP-A-61-97655. Furthermore, the coating methods disclosed in *Research Disclosure*, No. 17643, section XV, pages 28 -29, can be used for this purpose.

The present invention can be applied to various types of color photosensitive material.

For example, it can be applied typically to color reversal films for slides and television purposes, to color reversal papers, and to instant color films. Furthermore, it can also be applied to the color hard copy obtained from full color copying machines and the copy which is used to preserve CRT images. The present invention can also be applied to the black and white materials in which tri-color coupler mixtures are used disclosed, for example, in *Research Disclosure*, No. 17123 (published July 1978).

Moreover, the invention can also be applied to black and white photographic photosensitive materials.

Examples of black and white (B/W) materials to which the invention can be applied include the B/W direct positive photographic materials disclosed in JP-A-59-208540 and JP-A-60-260039 (for example, sensitive materials for X-ray purposes, duping materials, sensitive materials for micro work, camera sensitive materials, and sensitive materials for printing applications.

The fogging process in the present invention may be realized with a "light fogging method" and/or a "chemical fogging method" as described below. A full surface exposure, which is to say a fogging exposure, in the "light fogging method" in this invention is carried out after imagewise exposure and before and/or during development processing. The exposure is made while the imagewise exposed photosensitive material is immersed in the development bath or in the development pre-bath, or while the photosensitive material has been taken out from these baths but not dried. However, the exposure is preferably made while the imagewise exposed photosensitive material is immersed in the development bath.

The color development baths used to develop the photosensitive materials of this present invention are preferably aqueous alkaline solutions which contain a primary aromatic amine based color developing agent as the principal component. Aminophenol based compounds are useful as color developing agents, but the use of p-phenylenediamine based compounds is preferred. Typical examples of these compounds include 2-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used conjointly, according to the intended purpose.

The pH of these color development baths is from 9 to 12, and preferably from 9.5 to 11.5.

The photographic emulsion layer is usually subjected to a bleaching process after color development. The bleaching process can be carried out at the same time as the fixing process (in a bleach-fix process) or the two processes can be carried out separately. Moreover, a processing procedure in which bleach-fixing is carried out after a bleaching process can be adopted in order to speed up processing. Moreover, processing can be carried out by bleach-fixing in two connected baths, a fixing process can be carried out before a bleach-fixing process, or a bleaching process can be carried out after a bleach-fixing process optionally according to the intended purpose.

The silver halide color photographic materials of the present invention are usually subjected to a water washing process and/or stabilization process after the de-silvering process. The amount of wash water used in the washing process can be fixed within a wide range, depending on the application and the nature (for example the materials such as couplers which have been used) of the photosensitive material, the wash water temperature, the number of water washing tanks (the number of water washing stages) and the replenishment system, i.e. whether a counter flow or a sequential flow system is used, and various other conditions. The relationship between the amount of water used and the number of washing tanks in a multi-stage counter-flow system can be obtained using the method outlined on pages 248 -253 of the *Journal of the Society of Motion Picture and Television Engineers*, Volume 64 (May 1955).

Color developing agents may be incorporated into silver halide color photosensitive materials of the present invention to simplify and speed up processing. The use of various color developing agent precursors is preferred for incorporation.

On the other hand, a variety of known developing agents can be used to develop black and white photosensitive materials of the present invention. The following can be used, either individually or in combination: polyhydroxybenzenes (for example hydroquinone, 2-chlorohydroquinone, 2-methylhydroquinone, catechol, pyrogallol); aminophenols (for example p-aminophenol, N-methyl-p-aminophenol, 2,4-diaminophenol); 3-pyrazolidones (for example 1-phenyl-3-pyrazolidone, 1-phenyl-4,4,-dimethyl-3-pyrazolidone,1-phenyl-4-methyl-hydroxymethyl-3-pyrazolidone, 5,5-dimethyl-1-phenyl-3-pyrazolidone); and ascorbic acids. Furthermore, the development baths disclosed in JP-A-58-55928 can be used.

Detailed examples of the developing agents, preservatives, buffers and methods of development, for black and white photosensitive materials, and methods of use, have been disclosed, for example, in *Research Disclosure*, No. 17643 (published December 1978), sections XIX-XXI.

The invention is described in detail below by means of illustrative examples, but the invention is not limited by these examples.

EXAMPLE 1

A color photographic photosensitive material was prepared by coating the first to the fourteenth layers indicated below on the surface of a paper support which had been laminated on both sides with polyethylene (thickness 100 microns) and coating the fifteenth and sixteenth layers indicated below on the reverse side of the support. Titanium oxide (4 g/m$^2$) was included as a white pigment and a trace (0 003 g/m$^2$) of ultramarine as a bluing dye was included in the polyethylene on the side of the support on which the first layer was coated. (The chromaticity of this surface of the support in the L*, a*, b* system was 88.0, −0.20, −0.75.)

Photosensitive Layer Composition

The components and coated weights (in units of g/m$^2$) are indicated below. In the case of the silver halides the coated weights are indicated after calculation as silver. The emulsions used in each layer were prepared using the emulsion EM1 preparation method with the same core and shell silver halide mol ratio. However, a Lippman emulsion with no surface chemical sensitization was used for the emulsion in the fourteenth layer.

| | |
|---|---|
| First Layer (Anti-halation Layer): | |
| Black colloidal silver | 0.10 |
| Gelatin | 0.70 |
| Second Later (Intermediate Layer): | |
| Gelatin | 0.70 |
| Third Layer (Low Speed Red Sensitive Layer): | |
| Silver bromide (average grain size 0.25 μm, size distribution (variation coefficient) 8%, octahedral) spectrally sensitized with the red sensitizing dyes (ExS-1,2,3) | 0.04 |
| Silver chlorobromide (5 mol. % AgCl, average grain size 0.40 μm, size distribution 10%, octahedral) spectrally sensitized with the red sensitizing dyes (ExS-1,2,3) | 0.08 |
| Gelatin | 1.00 |
| Cyan coupler (ExC-1,2,3; 1:1:0.2) | 0.30 |
| Anti-color fading agent (Equal amounts of Cpd-1,2,3,4) | 0.18 |
| Anti-staining agent (Cpd-5) | 0.003 |
| Coupler dispersion medium (Cpd-6) | 0.03 |
| Coupler solvent (Equal amounts of Solv-1,2,3) | 0.12 |
| Fourth Layer (High Speed Red Sensitive Layer): | |
| Silver bromide (average grain size 0.60 μm, size distribution 15%, octahedral) spectrally sensitized with the red sensitizing dyes (ExS-1,2,3) | 0.14 |
| Gelatin | 1.00 |
| Cyan coupler (ExC-1,2,3; 1:1:0.2) | 0.30 |
| Anti-color fading agent (equal amounts of Cpd-1,2,3,4) | 0.18 |
| Coupler dispersion medium (Cpd-6) | 0.03 |
| Coupler solvent (equal amounts of Solv-1,2,3) | 0.12 |
| Fifth Layer (Intermediate Layer): | |
| Gelatin | 1.00 |
| Anti-color mixing agent (Cpd-7) | 0.08 |
| Anti-color mixing agent solvent (Equal amounts of Solv-4,5) | 0.16 |
| Polymer latex (Cpd-8) | 0.10 |
| Sixth Layer (Low Speed Green Sensitive Layer): | |
| Silver bromide (average grain size 0.25 μm, size distribution 8%, octahedral) spectrally sensitized with the green sensitizing dye (ExS-4) | 0.04 |
| Silver chlorobromide (5 mol. % AgCl, average grain size 0.40 μm, size distribution 10%, octahedral) spectrally sensitized with the green sensitizing dye (ExS-4) | 0.06 |
| Gelatin | 0.80 |
| Magenta coupler (equal amounts of ExM-1,2,3) | 0.11 |
| Anti-color fading agent (Equal amounts of Cpd-9,26) | 0.15 |
| Anti-staining agent (Cpd-10,11,12,13 in the ratio 10:7:7:1) | 0.025 |
| Coupler dispersion medium (Cpd-6) | 0.05 |
| Coupler solvent (equal amounts of Solv-4,6) | 0.15 |
| Seventh Layer (High Speed Green Sensitive Layer): | |
| Silver bromide (average grain size 0.65 μm, size distribution 16%, octahedral) spectrally sensitized with the green sensitizing dye (ExS-4) | 0.10 |
| Gelatin | 0.80 |
| Magenta coupler (equal amounts of ExM-1,2,3) | 0.11 |
| Anti-color fading agent (equal amounts of Cpd-9,26) | 0.15 |
| Anti-staining agent (Cpd-10,11,12,13 in the ratio 10:7:7:1) | 0.025 |
| Coupler dispersion medium (Cpd-6) | 0.05 |
| Coupler solvent (equal amounts of Solv-4,6) | 0.15 |
| Eighth Layer (Intermediate Layer): | |
| Same as the fifth layer. | |
| Ninth Layer (Yellow Filter Layer): | |
| Yellow colloidal silver (Grain size 200 Å) | 0.12 |
| Gelatin | 0.70 |
| Anti-color mixing agent (Cpd-7) | 0.03 |
| Anti-color mixing agent solvent (equal amounts of Solv-4,5 | 0.10 |
| Polymer latex (Cpd-8) | 0.07 |
| Tenth Layer (Intermediate Layer): | |
| Same as the fifth layer. | |
| Eleventh Layer (Low Speed Blue Sensitive Layer): | |
| Silver bromide (average grain size 0.40 μm, size distribution 8%, octahedral) spectrally sensitized with the blue sensitizing dyes (ExS-5,6) | 0.07 |
| Silver chlorobromide (8 mol. % AgCl, average grain size 0.60 μm, size distribution 11%, octahedral) spectrally sensitized with the blue sensitizing dyes (ExS-5,6) | 0.14 |
| Gelatin | 0.80 |
| Yellow coupler (equal amounts of Ex-1,2) | 0.35 |
| Anti-color fading agent (Cpd-14) | 0.10 |
| Anti-staining agent (Cpd-5,15 in the ratio 1:5) | 0.007 |
| Coupler dispersion medium (Cpd-6) | 0.05 |
| Coupler solvent (Solv-2) | 0.10 |
| Twelfth Layer (High Speed Blue Sensitive Layer): | |
| Silver bromide (average grain size 0.85 μm, size distribution 18%, octahedral) spectrally sensitized with the blue sensitizing dyes (ExS-5,6) | 0.15 |
| Gelatin | 0.60 |
| Yellow coupler (equal amounts of ExY-1,2) | 0.30 |
| Anti-color fading agent (Cpd-14) | 0.10 |
| Anti-staining agent (Cpd-5,15 in the ratio 1:5) | 0.007 |
| Coupler dispersion medium (Cpd-6) | 0.05 |
| Coupler solvent (Solv-2) | 0.10 |
| Thirteenth Layer (Ultraviolet Absorbing Layer): | |
| Gelatin | 1.00 |
| Ultraviolet absorber (Equal amounts of Cpd-2,4,16) | 0.50 |
| Anti-color mixing agent (Equal amounts of Cpd-7,17) | 0.03 |
| Dispersion medium (Cpd-6) | 0.02 |
| Ultraviolet absorber solvent (Equal amounts of Solv-2,7) | 0.08 |
| Anti-irradiation dye (Cpd-18,19,20,21,27 in the ratio 10:10:13:15:20) | 0.05 |
| Fourteenth Layer (Protective Layer): | |
| Fine grained silver chlorobromide (97 mol. % AgCl, average size 0.1 μm) | 0.03 |
| Acrylic modified copolymer of poly(vinyl alcohol) average molecular weight 50.000) | 0.01 |
| Poly(methyl methacrylate) grains (Average particle size 3.4 μm) and silicon oxide (Average particle size 5 μm) in equal amounts | 0.05 |
| Gelatin | 1.80 |
| Gelatin hardening agent (equal amounts of H-1, H-2) | 0.18 |
| Fifteenth Layer (Backing Layer): | |
| Gelatin | 2.50 |
| Ultraviolet absorber (equal amounts of Cpd-2,4,16) | 0.50 |
| Dye (Equal amounts of Cpd-18,19,20,21,27) | 0.06 |
| Sixteenth Layer (Backing Protective Layer): | |
| Poly(methyl methacrylate grains (Average particle size 2.4 μm) and silicon oxide (Average particle size 5 μm) in equal amounts | 0.05 |
| Gelatin | 2.00 |
| Gelatin hardening agent (equal amounts of H-1, H-2) | 0.14 |

Preparation of Emulsion EM-1

Aqueous solutions of potassium bromide and silver nitrate were added simultaneously over a period of 15 minutes at 75° C. to an aqueous gelatin solution and octahedral silver bromide grains of average grain size 0.50 μm were obtained. 3,4-dimethyl-1,3-thiazolin-2-thione (0.3 gram), 6 mg of sodium thiosulfate and 7 mg of chloroauric acid (tetrahydrate) were added sequentially per mol of silver to this emulsion and chemical sensitization was carried out by heating to 75° C. for 80 minutes. The grains obtained in this way were then used as core grains which were grown under the same precipitation conditions as on the first occasion and ultimately an octahedral mono-disperse core/shell silver bromide emulsion of an average grain size 0.7 μm was obtained. The silver halide mol ratio of the core and shell was 1 : 1.7. The variation coefficient of the grain size was about 10%. Sodium thiosulfate (1.5 mg) and 1.5 mg of chloroauric acid (tetra-hydrate) were added per mol of silver to this emulsion, and chemical sensitization was carried out by heating to 60° C. for 60 minutes, and an internal latent image type silver halide emulsion was obtained.

A cylindrical type agitated tank of diameter 20 cm with a liquid depth of 20 cm was used for the reactor. Baffle plates were established in the reactor, and a 6 blade turbine (blade width 1.5 cm) of diameter 7.5 cm was positioned in the center of the agitated tank. The turbine blades could be rotated at 2000 rev/min and 200 rev/min. The rate of rotation during the preparation of EM-1 was 2000 rev/min.

N-I-16 was added as a nucleating agent to each photosensitive layer at a rate of $4.5\times10^{-6}$ mol per mol of silver as silver halide, and Cpd-22 was added as a nucleation accelerator at a rate of $4.5\times10^{-6}$ mol per mol of silver. Moreover Alkanol XC (Dupont Co.) and sodium alkylbenzenesulfonate were included in each layer as emulsification and dispersing agents, and Magefac F-120 (Dainippon Ink Co.) was used in each layer as a coating promotor. (Cpd-23,24,25) was used as a stabilizer in the silver halide and colloidal silver containing layers. The sample so obtained was sample 101. The compounds used in this example are indicated below.

ExS-1

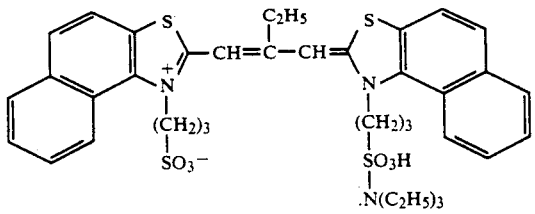

ExS-2

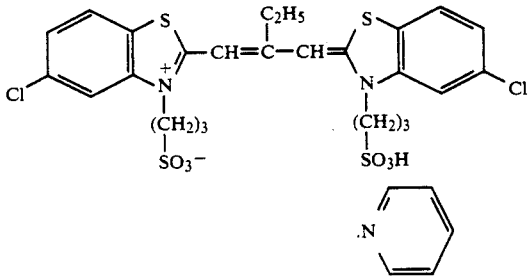

ExS-3

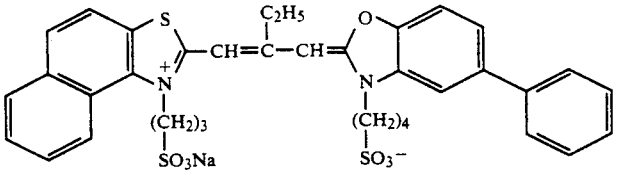

ExS-4

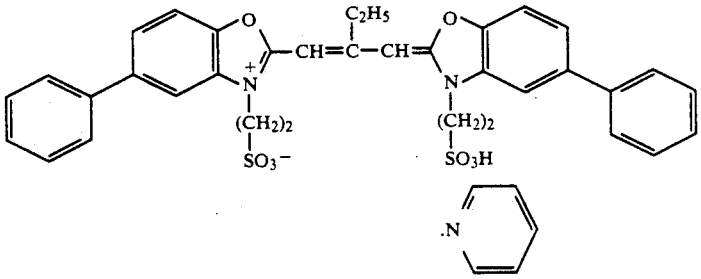

ExS-5

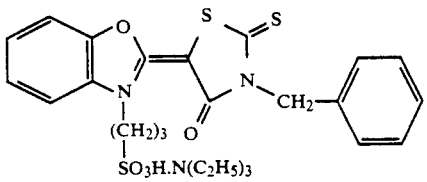

-continued
ExS-6
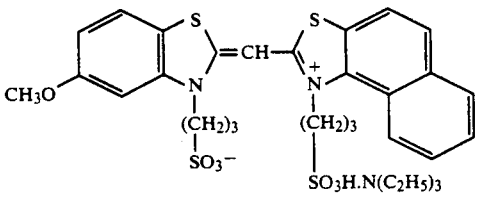
Cpd-1
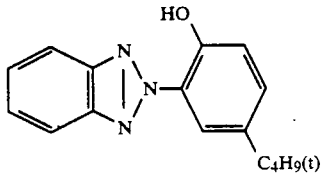
Cpd-2
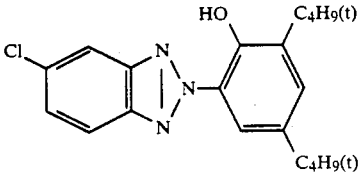
Cpd-3
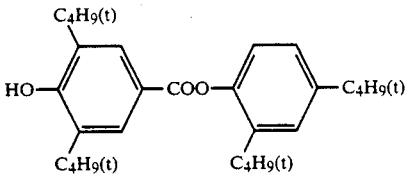
Cpd-4
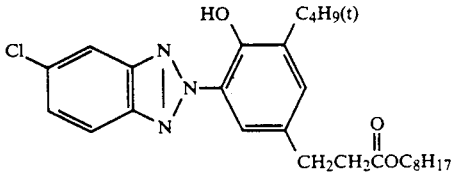
Cpd-5
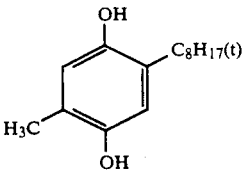
Cpd-6
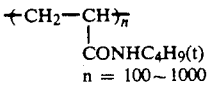
Cpd-7
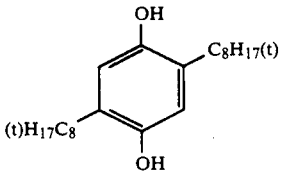
Cpd-8
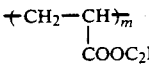

-continued
Cpd-9
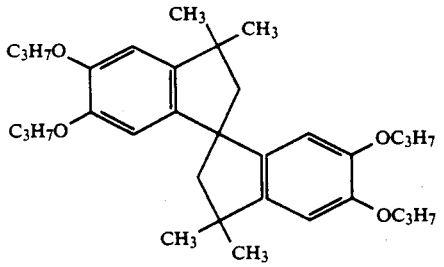
Cpd-10
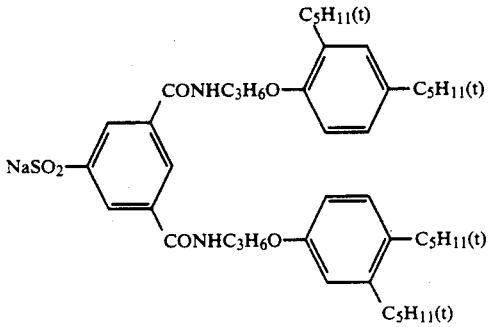
Cpd-11
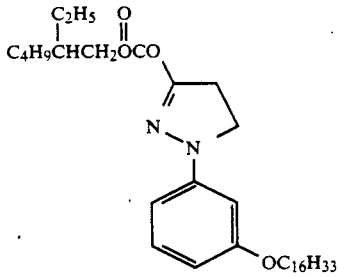
Cpd-12
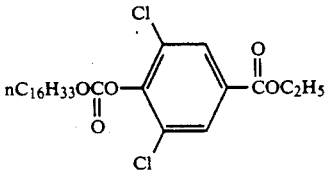
Cpd-13
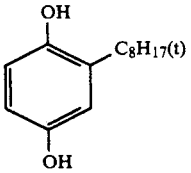
Cpd-14
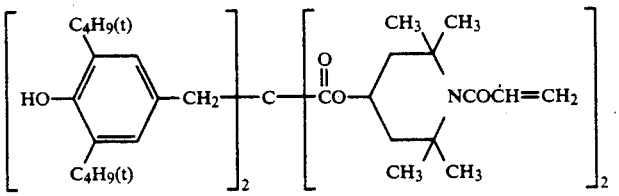
Cpd-15
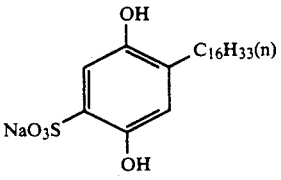

-continued
Cpd-16
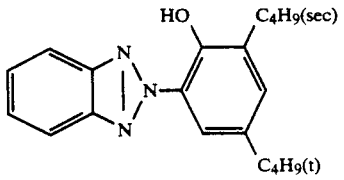
Cpd-17
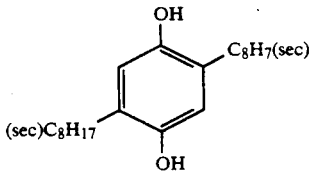
Cpd-18
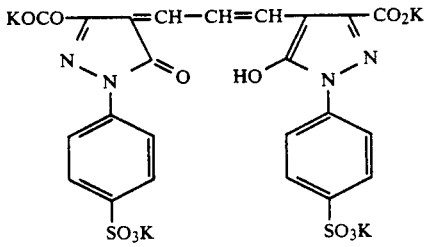
Cpd-19
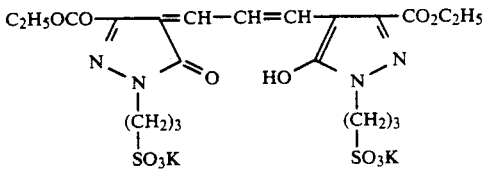
Cpd-20
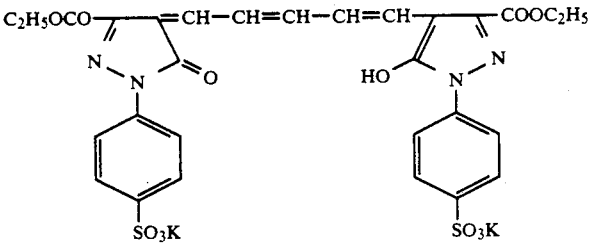
Cpd-21
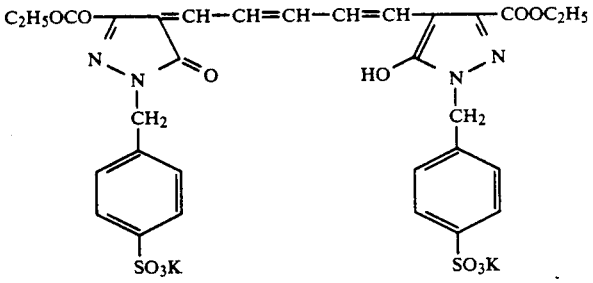
Cpd-22
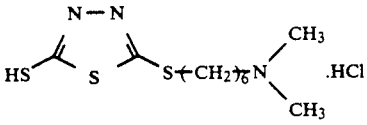
Cpd-23
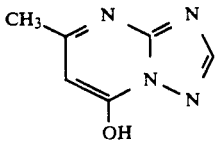

-continued
Cpd-24
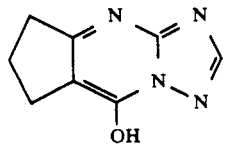
Cpd-25
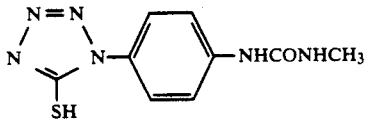
Cpd-26
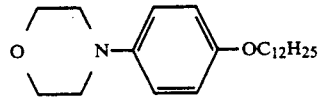
Cpd-27
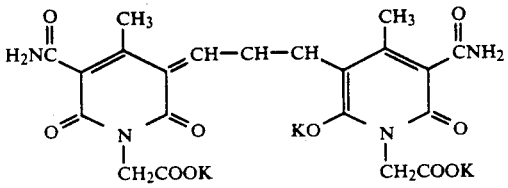
EXC-1
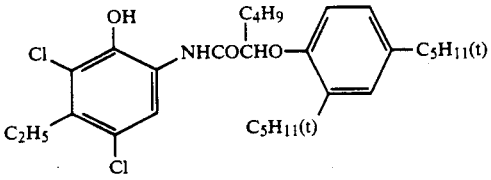
EXC-2
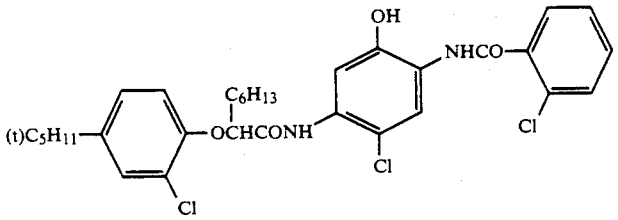
EXC-3
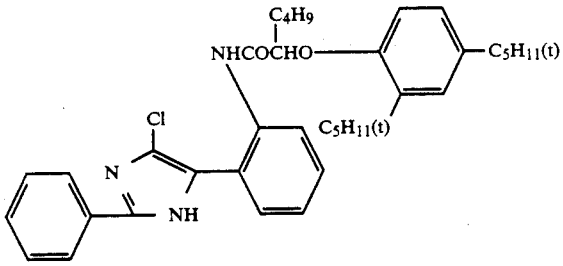
EXM-1
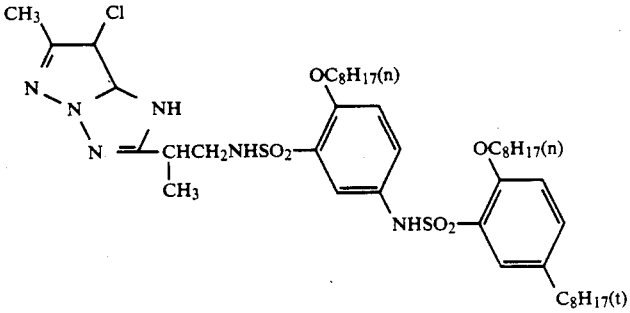

-continued

EXM-2

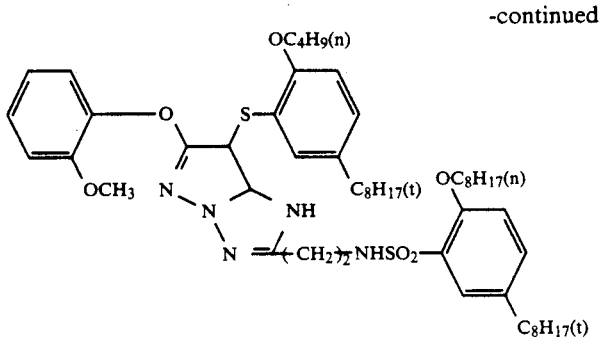

EXM-3

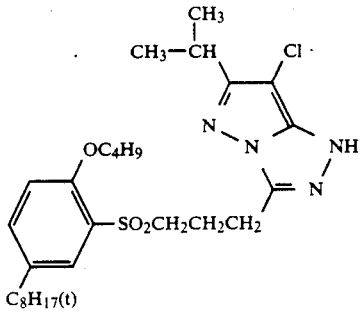

EXY-1

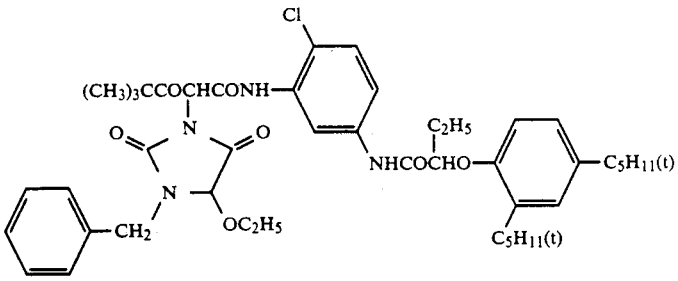

EXY-2

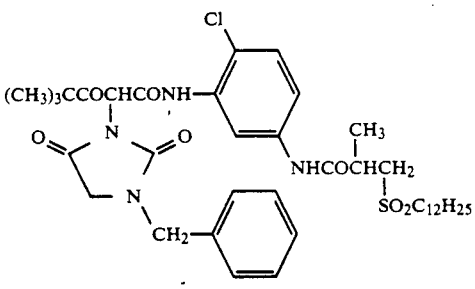

| | |
|---|---|
| Solv-1: | Di(2-ethylhexyl sebacate |
| Solv-2: | Trinonyl phosphate |
| Solv-3: | Di(3-methylhexyl) phthalate |
| Solv-4: | Tricresyl phosphate |
| Solv-5: | Dibutyl phthalate |
| Solv-6: | Trioctyl phosphate |
| Solv-7: | Di(2-ethylhexyl) phthalate |
| H-1: | 1,2-Bis(vinylsulfonylacetamido)ethane |
| H-2: | 4,6-Dichloro-2-hydroxy-1,3,5-triazine, sodium salt |

Preparation of Samples 102–110

Samples 102 to 110 were prepared in the same way as the emulsion EM-1, the internal latent image core/shell type silver halide emulsion of example 101, except that the silver halide mol ratio of the core and shell, and the agitation rate of the agitation chamber in the reactor were changed. The core/shell ratio and the agitation rate for each sample are shown in table 1.

The samples 101–110 prepared in this way were exposed through a continuous wedge and developed and processed in the way indicated below, after which the cyan, magenta and yellow densities were measured and the minimum densities ($D_{min}$) were obtained.

The above mentioned samples 101–110 were also stored at 30° C., 55% RH for 3 months and then they were exposed and developed in the same way as before, density measurements were made and the $D_{min}$ values were obtained.

The results obtained are shown in Table 1.

Furthermore, the samples 101–110 were subjected to a uniform exposure to provide cyan, magenta and yellow densities of 1.0 after development processing. Ten seconds after the start of the development processing indicated below, the emulsions were scratched by applying a continuously varying load to a steel ball needle of diameter 0.8 mm on the swelled layer in the development bath. The load at which desensitization commenced was obtained for cyan, magenta and yellow after development processing in the way described below. These results are also shown in Table 1.

| Processing Operation | Time | Temperature | Parent Bath Capacity | Replenishment Rate |
|---|---|---|---|---|
| Color Development | 135 sec. | 38° C. | 15 liters | 300 ml/m$^2$ |
| Bleach-fix | 40 sec. | 33° C. | 3 liters | 300 ml/m$^2$ |
| Water Wash (1) | 40 sec. | 33° C. | 3 liters | — |
| Water Wash (2) | 40 sec. | 33° C. | 3 liters | 320 ml/m$^2$ |
| Drying | 30 sec. | 80° C. | — | — |

The replenishment system for the water washing water involved a so-called counter current replenishment system with replenishment of water washing bath (2) and transfer of the overflow from the water washing bath (2) to water washing bath (1). At this time, the carry over of bleach-fix bath into water washing tank (1) from the bleach-fix bath by the photosensitive material was 35 ml/m$^2$, and the rate of replenishment was 9.1 times the carry over of bleach-fix bath.

The composition of each processing bath is indicated below:

| Color Development Bath | Parent Bath | Replenisher |
|---|---|---|
| D-Sorbitol | 0.15 gram | 0.20 gram |
| Sodium naphthalenesulfonate/formalin condensate | 0.15 gram | 0.20 gram |
| Ethylenediaminetetrakismethylenephosphonic acid | 1.5 grams | 1.5 grams |
| Diethylene Glycol | 12.0 ml | 16.0 ml |
| Benzyl alcohol | 13.5 ml | 18.0 ml |
| Potassium bromide | 0.80 gram | — |
| Benzotriazole | 0.003 gram | 0.004 gram |
| Sodium sulfite | 2.4. grams | 3.2 grams |
| N,N-Bis(carboxymethyl)-hydrazine | 6.0 grams | 8.0 grams |
| D-Glucose | 2.0 grams | 2.4 grams |
| Triethanolamine | 6.0 grams | 8.0 grams |
| N-Ethyl-N-(β-methanesulfonamidoethyl)-3-methyl-4-aminoaniline sulfate | 6.4 grams | 8.5 grams |
| Potassium carbonate | 30.0 grams | 25.0 grams |
| Fluorescent whitener (Stilbene base) | 1.0 gram | 1.2 grams |
| Water to make up to | 1000 ml | 1000 ml |
| pH (25° C.) | 10.25 | 10.75 |

-continued

| Bleach Fix Bath | Parent Bath | Replenisher |
|---|---|---|
| Ethylenediamine tetra-acetic acid, di-sodium, di-hydrate | 4.0 grams | Same as Parent Bath |
| Ethylenediamine tetra-acetic acid Fe(III).ammonium, di-hydrate | 70.0 grams | |
| Ammonium thiosulfate (700 g/l) | 180 ml | |
| Sodium p-toluenesulfinate | 20.0 grams | |
| Sodium bisulfite | 20.0 grams | |
| 5-Mercapto-1,3,4-triazole | 0.5 gram | |
| Ammonium nitrate | 10.0 gram | |
| Water to make up to | 1000 ml | |
| pH (25° C.) | 6.20 | |
| Water Washing Bath | Parent Bath = Replenisher | |

Tap water was passed through a mixed bed type column which had been packed with an H-type strongly acidic cation exchange resin ("Amberlite IR-120B", made by Rohm and Haas) and an OH-type anion exchange resin ("Amberlite IR-400", made by the same company) and treated so that the calcium and magnesium ion concentrations were below 3 mg/l after which 20 mg/l of sodium cyanurate dichloride and 1.5 g/l of sodium sulfate were added. The pH of this liquid was within the range 6.5 -7.5.

TABLE 1

| Sample Number | Core/Shell Silver Halide Ratio | Agitation Rate During Grain Formation (rpm) | Immediately After Coating $D_{min}$ | | | After 3 Months, 30° C., 55% RH $D_{min}$ | | | Load at which Pressure Desensitization Commenced | | |
|---|---|---|---|---|---|---|---|---|---|---|---|
| | | | Cyan | Magenta | Yellow | Cyan | Magenta | Yellow | Cyan | Magenta | Yellow |
| 101 (Comp. Example) | 1:1.7 | 2000 | 0.20 | 0.19 | 0.19 | 0.24 | 0.23 | 0.22 | 56 grams | 56 grams | 52 grams |
| 102 (Comp. Example) | 1:1.7 | 200 | 0.23 | 0.23 | 0.22 | 0.38 | 0.32 | 0.32 | 50 | 52 | 50 |
| 103 (Comp. Example) | 1:4.0 | 2000 | 0.19 | 0.19 | 0.20 | 0.22 | 0.23 | 0.22 | 59 | 58 | 50 |
| 104 (Comp. Example) | 1:4.0 | 200 | 0.21 | 0.22 | 0.21 | 0.32 | 0.30 | 0.30 | 52 | 54 | 52 |
| 105 (This Invention) | 1:5.0 | 2000 | 0.17 | 0.16 | 0.18 | 0.21 | 0.20 | 0.21 | 63 | 63 | 60 |
| 106 (This Invention) | 1:5.0 | 200 | 0.18 | 0.16 | 0.18 | 0.20 | 0.21 | 0.20 | 62 | 63 | 60 |
| 107 (This Invention) | 1:9.9 | 2000 | 0.17 | 0.17 | 0.17 | 0.20 | 0.20 | 0.21 | 67 | 68 | 65 |
| 108 (This Invention) | 1:9.9 | 200 | 0.17 | 0.17 | 0.16 | 0.21 | 0.20 | 0.24 | 65 | 68 | 68 |
| 109 (This Invention) | 1:30 | 2000 | 0.17 | 0.18 | 0.17 | 0.20 | 0.21 | 0.21 | 70 | 68 | 72 |
| 110 (This Invention) | 1:30 | 200 | 0.16 | 0.17 | 0.17 | 0.20 | 0.20 | 0.21 | 68 | 68 | 68 |

It is clear from the results shown in Table 1 that with Samples 101 -104, which are comparative examples, $D_{min}$ is very high immediately after coating and after ageing, particularly in those cases (Samples 102, 104) in which the rate of agitation during shell formation is low. On the other hand, with the samples of the present invention, Samples 105 -110, there was no rise in $D_{min}$ when the rate of agitation was low (Samples 106, 108, 110) and there was a considerable improvement in stability with respect to the range of conditions during the manufacture of the silver halide grains. Furthermore, it is also clear from Table 1 that all of Samples 105 -110 of this invention were less likely to pressure desensitization than comparative Samples 101 -104.

EXAMPLE 2

Similar results were obtained when the halogen composition of the internal latent image type core/shell emulsion of Example 1 was changed from silver bromide to 30 mol. % silver chloride, 70 mol. % silver bromide (with the same silver halide composition in the core and shell).

EXAMPLE 3

Similar results were obtained when the halogen composition of the internal latent image type core/shell emulsion of Example 1 was changed from silver bromide to 10 mol. % silver chloride, 90 mol. % silver bromide in the core.

EXAMPLE 4

Similar results were obtained when the form of the internal latent image type core/shell silver halide emulsion in Example 1 was changed from octahedral to cubic.

EXAMPLE 5

Samples were prepared in the same way as in Example 1 except that the nucleating agent (N-I-16) was changed to (N-I-1), (N-I-3), (N-I-7), (N-I-12) or (N-I-20) respectively during the preparation of samples 105 and 107 in example 1, and the results of tests carried out in the same way as in example 1 gave similar results in terms of photographic performance to those obtained with sample 105 in example 1.

EXAMPLE 6

The results obtained from preparing and testing samples in the same way as in Example 5, except that (N-II-1), (N-II-4) or (N-II-8) was used for the nucleating agent in example 5, exhibited photographic performance in which the maximum image density was about 20% below that obtained with the samples of Example 5.

The photosensitive materials of this present invention are able to provide positive images which have a low minimum image density. This result can be achieved irrespective of the conditions during the formation of the grains of the internal latent image type silver halide emulsion. Moreover, the photosensitive materials of this present invention retain a low minimum image density level even on ageing due to storage, and they exhibit little pressure sensitization or pressure desensitization.

While the present invention has been described in detail and with reference to specific embodiments thereof, it is apparent to one skilled in the art that various changes and modifications can be made therein without departing from the spirit and scope of the present invention.

What is claimed is:

1. A direct positive photographic photosensitive material which comprises at least one internal latent image core/shell type silver halide emulsion layer which has not been pre-fogged on a support and which contains a core and a shell wherein the silver halide molar ratio of the core and shell of said emulsion is not more than 1/5, and wherein at least one of the compounds represented by the following formula (N-I) is included in the photosensitive material:

(N-I)

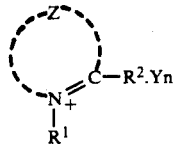

wherein Z represents a non-metal atomic group which is required to form a 5- or 6-membered heterocyclic ring, and Z may be substituted with substituents; $R^1$ is an aliphatic group; $R^2$ is a hydrogen atom, an aliphatic group or an aromatic group; $R^1$ and $R^2$ may be substituted with substituents; $R^2$ may be joined to the heterocyclic ring which is completed by Z and form a ring; Y is a counter ion for balancing the electrical charge, and n is 0 or 1; provided that at least one of the groups represented by $R^1$, $R^2$ and Z contains an alkynyl group, acyl group, hydrazine group or hydrazone group as a substituent, or that a 6-membered ring is formed with $R^1$ and $R^2$ and a dihydropyridinium skeleton is formed; provided that at least one of the groups represented by $R^1$, $R^2$ and Z may be a group which promotes adsorption on silver halide.

2. The direct positive photographic photosensitive material as in claim 1, wherein the silver iodide content in each of the silver halide emulsion layers is not more than 3 mol. % based on the silver halide content of the silver halide emulsion layer.

3. The direct positive photographic photosensitive material as in claim 1, wherein silver halide emulsion layer is silver iodide free.

4. The direct positive photographic photosensitive material as in claim 1, wherein $R^1$, $R^2$ and Z collectively contain at least one alkynyl or acyl substituent group.

5. The direct positive photographic photosensitive material as in claim 1, wherein $R^1$, $R^2$ and Z collectively contain at least one alkynyl substituent group.

6. The direct positive photographic photosensitive material as in claim 1, wherein $R^1$, $R^2$ and Z collectively contain at least one propargyl substituent group.

7. The direct positive photographic photosensitive material as in claim 1, wherein $R^1$ and $R^2$ are joined together to form a dihydropyridinium skeleton.

8. The direct positive photographic photosensitive material as in claim 1, wherein a compound which is represented by the following formula (N-II) is included in the photosensitive material:

$$R^{21}-\underset{\underset{R^{23}}{|}}{N}-\underset{\underset{R^{24}}{|}}{N}-G-R^{22} \qquad \text{[N-II]}$$

wherein $R^{21}$ represents an aliphatic group, aromatic group or a heterocyclic group; $R^{22}$ represents a hydrogen atom, or an alkyl, aryl, alkoxy, arylthio or amino group; G represents a carbonyl, sulfonyl, sulfoxy, phosphoryl or imido (HN=C ) group; and $R^{23}$ and $R^{24}$ each represents a hydrogen atom, or one represents a hydrogen atom and the other represents an alkylsulfonyl group, an arylsulfonyl group or an acyl group.

9. The direct positive photographic photosensitive material as in claim 8, wherein the compound represented by the formula (N-II) contains a ureido group, sulfonyl group, amino group or a group which is adsorbed on silver halide.

10. The direct positive photographic photosensitive material as in claim 1, wherein the silver halide molar ratio of the core and the shell of the emulsion is not more than 1/6.

11. The direct positive photographic photosensitive material as in claim 1, wherein said group which promotes adsorption on silver halide is represented by the formula $X^1$—$(L^1)_m$— wherein $X^1$ is a group which promotes adsorption on silver halide, $L^1$ is a divalent linking group, and m is 0 or 1.

12. The direct positive photographic photosensitive material as in claim 11, wherein said group which promotes adsorption on silver halide is a thioamido group, a mercapto group or a 5- or 6-membered nitrogen-containing heterocyclic group.

13. The direct positive photographic photosensitive material as in claim 1, wherein the heterocyclic ring completed by Z is a quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolinium, naphthoxazolium or benzoxazolium nucleus.

14. The direct positive photographic photosensitive material as in claim 1, wherein the compound represented by formula (N-I) in used in an amount of from $1 \times 10^{-8}$ to $1 \times 10^{-2}$ mole per mole of the silver halide.

15. The direct positive photographic photosensitive material as in claim 1, wherein said material further contains tetra-azaindenes, triazaindenes or penta-azaindenes which have at least one mercapto group which may be substituted with an alkali metal atom or an ammonium group.

16. The direct positive photographic photosensitive material as in claim 10, wherein the silver halide molar ratio of the core and the shell of the emulsion is not more than 1/9.9.

* * * * *